United States Patent [19]

Carr et al.

[11] Patent Number: 4,661,120

[45] Date of Patent: Apr. 28, 1987

[54] DIESEL FUEL ADDITIVE

[75] Inventors: Richard P. Carr, Naperville; Marcos Y. Corpuz, Lisle, both of Ill.

[73] Assignee: Nalco Chemical Company, Oak Brook, Ill.

[21] Appl. No.: 754,304

[22] Filed: Jul. 12, 1985

[51] Int. Cl.[4] ..... C10L 1/18

[52] U.S. Cl. ..... 44/57; 44/62; 44/77; 44/75

[58] Field of Search ..... 44/57, 62, 77, 75

[56] References Cited

U.S. PATENT DOCUMENTS

| | | | |
|---|---|---|---|
| 2,984,550 | 5/1961 | Chamot | 44/75 |
| 3,660,057 | 5/1972 | Ilnyckyj | 44/62 |
| 3,773,478 | 11/1973 | Feldman | 44/62 |
| 3,980,569 | 9/1976 | Pindar et al. | 44/75 |
| 4,460,453 | 7/1984 | Gudelis et al. | 208/33 |
| 4,516,981 | 5/1985 | Nelson, Jr. et al. | 44/77 |

OTHER PUBLICATIONS

*Flow Improvers and Pour Point Depressants,* edited by M. Gillies, Noyes Data Corp., Park Ridge, NJ, 1982, pp. 115–140.

*Boiler Fuel Additives for Pollution Reduction & Energy Saving,* edited by Eliot, Noyes Data Corp., Park Ridge, NJ, 1978, p. 122.

*Surfactants & Interfacial Phenomena,* Rosen, Wiley, 1978, pp. 136–142.

*Primary Examiner*—Y. Harris-Smith

*Attorney, Agent, or Firm*—John G. Premo; Anthony L. Cupoli; Donald G. Epple

[57] ABSTRACT

An improved cold weather diesel fuel treatment of the type comprising:

| Ingredients | % by Weight |
|---|---|
| A. wax crystal modifier | 10 to 50% |
| B. sludge dispersant & stabilizer | 1 to 10% |
| C. hydrocarbon solvent | 15 to 40% |
| D. oil-soluble water solvent comprising of a low molecular weight organic compound containing from 1 to 3 structural units having the formula: $-CH_2CH_2O-$. | 15 to 40% |

2 Claims, No Drawings

DIESEL FUEL ADDITIVE

INTRODUCTION

It is common practice for rucking firms and independent truckers to utilize what may be termed "diesel fuel oil winter fuel treatments." These products are added to diesel fuel oils in the winter to provide several beneficial effects. In one instance, they inhibit the gelling of the fuel which is caused by wax crystal formation. The additives also tend to prevent fuel destabilization which means that sludge and gum formation are inhibited. This helps keep injection nozzles clean and fuel filters from plugging prematurely.

A serious problem occasioned by the use of diesel fuels in sub-zero temperatures resides in the effect of the cold weather on water which is often present in these fuels. This water is in the fuel and can come from many sources. A primary source is condensation under conditions of storage although accidental spills under storage conditions or other reasons can add undesirable amounts of water to diesel fuels.

In colde weather this dissolved or entrained water can occasion fuel filter plugging. Also, if allowed to separate from the fuel, it can form a lower strata in fuel tanks, thereby causing corrosion, and can ice up and freeze, forming a potential condition of fuel tank rupture.

It would be beneficial to the art if it were possible to provide an improved winter fuel treatment for diesel fuels which, in addition to having the properties and characteristics described above, would be able to dissolve or disperse the water often present in such fuels to render it harmless under conditions of storage and use of such contaminated fuels.

THE INVENTION

The invention comprises an improved cold weather diesel fuel treatment of the type comprising:

| Ingredients | % by Weight |
|---|---|
| A. wax crystal modifier | 10 to 50% |
| B. sludge dispersant & stabilizer | 1 to 10% |
| C. hydrocarbon solvent | 15 to 40% |
| D. oil-soluble water solvent comprising of a low molecular weight organic compound containing from 1 to 3 structural units having the formula: $-CH_2CH_2O-$. | 15 to 40% |

In a preferred embodiment of the invention, the wax crystal modifier is employed in a percent by weight amount ranging between 20–40. The sludge dispersant and stabilizer is used between 2–6%; the hydrocarbon solvent, between 20–40%; and the oil-soluble water solvent, between 20–40%.

The above fuel treatments may be used in dosages based on percent by weight ranging between 0.05–15%. In most cases dosages between 0.01–5% by weight give good results.

The compositions of the invention, when used to treat water-contaminated diesel fuels, are most effective when the water content of the fuel on a volume basis does not exceed 5%. Typically, water-contaminate diesel fuels contain between 100–500 ppm.

The Wax Crystal Modifier

Wax crystal modifiers are well known chemicals. They are oftentimes used in the refining of lubricating oils and in these applications, they are referred to as dewaxing aids. Typical of such materials are ethylene vinyl acetate copolymers, esters of aliphatic alcohols having from 2–20 carbon atoms with acrylic or methacrylic acid, polydialkyl fumarates, fumarate vinyl acetate copolymers, as well as many other related materials that are well known in the art. Typical of such dewaxing aids or wax crystal modifiers are described in U.S. Pat. No. 4,460,453 as well as the references cited thereagainst, all of which are incorporated herein by reference.

A preferred wax crystal modifier used in the practice of this invention is the copolymer of ethylene and vinyl acetate having a molecular weight within the range of 1,000–100,000 and, preferably 1,000–50,000, and which contain between about 5–35% by weight of vinyl acetate.

The Sludge Dispersant and Stabilizer

A variety of these materials exist and any number may be used in the practice of the invention. A partial list of such materials is presented below:

- N,N-Dimethylcyclohexylamine;
- Alkenyl succinic acid anhydride, polyamine and salicylaldehyde;
- Metal salts of alkyl phenol-ethyleneamine reaction product;
- Alkylamine salts;
- Secondary alkyl or cycloalkyl primary amines;
- Organic halophosphite ester reaction products;
- Amine salts or carboxylic acid esters of phosphinic acid;
- N-substituted alkoxyalkylamines;
- 1-aza bicyclo alkane;
- Coordinate complexes of nitrogenous compounds;
- Amide with Schiff base and a cyclohexylamine;
- Reaction product of an epichlorohydrin and a B-alkylamine.

For additional information regarding these materials, see the chapter on page 122 of the volume, *Boiler Fuel Additives for Pollution Reduction and Energy Saving*, Edited by R. C. Eliot, Noves Data Corp., Park Ridge, N.J., 1978.

A preferred material is a polymer prepared by reacting an alkyl phenol formaldehyde and ethylenediamine. Such polymers and their method of preparation are described in detail in U.S. Pat. No. 2,984,550. A preferred polymer is the reaction product of 1 mole of dodecyl phenol with 2 moles of formaldehyde and 1 mole of ethylene diamine. This is then mixed and reacted at low temperature with a dibutylamine formaldehyde complex to produce a preferred sludge dispersant and stabilizer. The polymer is used at 70% by weight and is combined with the ethylene diamine formaldehyde polymer at 30% by weight. These reactions are conducted in an aeromatic solvent, the content of which in the final sludge stabilizing composition is about 22%.

The Oil-Soluble Water Solvent

As indicated, this component used to prepare the compositions of the invention should contain a $-CH_2CH_2O-$ structural unit within its molecular makeup. These compounds are also characterized in that they must be oil-soluble and be capable of dissolving water. Compounds of this type are known. A generalized discussion of compounds of this type is set forth in the textbook, *Surfactants and Interfacial Phenomena*, Rosen, Milton J., John Wiley & Sons, 1978, at pages 136–142. A preferred material of this type is the monobutyl ether of ethylene glycol. The water solvent may be either a single chemical or it may be a mixture. Such a mixture is illustrated by a 50/50 weight blend of the monobutyl ether of ethylene glycol with nonyl phenol reacted with between 1–3 moles of ethylene oxide. Such a material is available commercially under the trade name, Igepal Co-520. Usually the oil-soluble water solvent has a molecular weight less than 500.

The Hydrocarbon Solvent

The hydrocarbon solvent used in the practice of the invention may be selected from a wide number of materials. Preferably aromatic hydrocarbons are used. Preferably blended aromatic hydrocarbons of the type resulting from the refining of petroleum. Pure solvents such as benzene, xylene, or toluene may be used although a high degree of purity in the solvent is not needed. Similarly, mixed aliphatic solvents or pure aliphatic solvents may be used although, as indicated, the aromatics are preferred.

TYPICAL FORMULAS

Typical formulas used in the practice of the invention are set forth below:

| | |
|---|---|
| Formula A | |
| EVA polymer (10% solvent) | 30.00% |
| Sludge Dispersant | 4.75% |
| Diethylene glycol monobutyl ether | 35.25% |
| Heavy aromatic naphtha | 30.00% |
| Formula B | |
| EVA polymer (10% solvent) | 30.00% |
| Sludge Dispersant | 4.75% |
| Diethylene glycol monobutyl ether | 20.00% |
| Oil-soluble nonyl phenol reacted with 1 mole ethylene oxide | 15.25% |
| Heavy Aromatic Naphtha | 30.00% |
| Formula C | |
| EVA polymer (10% solvent) | 30.00% |
| Sludge Dispersant | 4.75% |
| Heavy aromatic naphtha | 65.25% |

Evaluation of the Invention

The formulations were tested to evaluate their effect on wax crystal formation in diesel fuel. Fuel treated with the two formulations at the recommended dosage of 0.1% was subjected to the Pour Point and Cold Filter Plug Point (CFPP) tests and compared with untreated fuel and fuel treated without the water solvent with the following results:

| | Pour Point | Cold Filter Plug Point |
|---|---|---|
| Untreated fuel | 5° F. | +12° F. |
| Formula C treated fuel | 30° F. | 4° F. |
| Formula A treated fuel | 30° F. | 16° F. |
| Formula B treated fuel | 30° F. | 6° F. |

Formula A was chosen over Formula B because of its superior performance in the CFPP test.

Free and settled water in fuel can be eliminated by good fuel handling practices. It was, therefore, decided to determine the effect of the new formulation on dispersed and dissolved water in fuel.

One-tenth percent water was added to fuel containing 0.1% of Formula A. On shaking, a slightly hazy, stable emulsion resulted. Microscopic examination of the emulsion showed the size of the water droplets to be mainly 1–2 microns with very few droplets ranging up to 5 microns in diameter. When the sample was cooled as low as −50° F., no ice crystal formation was seen and the droplets remained as spheres. Whether the spheres were solid ice or still liquid could not be determined. However, the droplets remained at a size small enough to easily pass through a fuel filter.

Subsequent tests showed that Formulas A and B were tested by emersing at 130° F. for 1 week elastomers of the type typically used as components of diesel engine parts in Formulas A and B. In all cases, there was no degradation of the following type elastomers: fluorosilicone, silicone, peroxide cured nitrile, fluoroelastomer, sulfur cured nitrile, and fluoroelastomer blend.

Having thus described our invention, it is claimed as follows:

1. An improved cold weather diesel fuel treatment of the type comprising:

| Ingredients | % by Weight |
|---|---|
| A. wax crystal modifier | 10 to 50% |
| B. sludge dispersant & stabilizer | 1 to 10% |
| C. hydrocarbon solvent | 15 to 40% |
| D. oil-soluble water solvent comprising of a low molecular weight organic compound containing from 1 to 3 structural units having formula: $—CH_2CH_2O—$ | 15 to 40% |

said improved cold weather diesel fuel treatment being capable of dispersing or dissolving water contained in diesel fuels.

2. The improved cold weather diesel fuel treatment of claim 1 wherein the wax crystal modifier is a low molecular weight ethylene vinyl acetate copolymer; the sludge dispersant is an alkyl phenol formaldehyde polyamine polymer; and the oil-soluble water solvent is an oil-soluble low molecular weight diethylene glycol ether.

* * * * *